United States Patent [19]

Ellis

[11] Patent Number: 4,573,590

[45] Date of Patent: Mar. 4, 1986

[54] CLIP STRIP DISPLAY UNIT

[75] Inventor: Jeffrey Ellis, Spring Valley, N.Y.

[73] Assignee: Bristol-Myers Company, New York, N.Y.

[21] Appl. No.: 686,325

[22] Filed: Dec. 26, 1984

[51] Int. Cl.[4] ..... A47F 5/00

[52] U.S. Cl. ..... 211/86; 40/16.6; 211/118; 248/221.4

[58] Field of Search ..... 211/86.71, 113, 118, 211/89; 248/220.2, 221.4, 231.2, 223.4; 40/10 R, 11 R, 16.4, 16.6

[56] References Cited

U.S. PATENT DOCUMENTS

| | | | |
|---|---|---|---|
| 4,071,146 | 1/1978 | Batts | 211/118 X |
| 4,179,138 | 12/1979 | Bogdanovic | 248/221.4 X |
| 4,215,840 | 8/1980 | Babberl | 248/221.4 |
| 4,291,810 | 9/1981 | Rubenstein | 248/316.7 X |
| 4,477,048 | 10/1984 | Conway | 40/10 R X |
| 4,483,502 | 11/1984 | Fast | 248/220.2 X |

*Primary Examiner*—Robert W. Gibson, Jr.
*Attorney, Agent, or Firm*—Gabriel P. Katona

[57] ABSTRACT

A clip strip display unit to which a plurality of packaged items may be clipped for display; the unit being capable of being expanded to fit into a variety of vertical spaces; the unit also being provided with a variety of securing means for securing it in position, these securing means being of the type that will be adapted for use in the usual retail installations that are likely to be encountered.

6 Claims, 10 Drawing Figures

3
7
49
53
29
57
47
45
37
51
23
17
25
5
33
19
11
27
15
13
21
9
31
35
55

3
5
7
11
17
19
21
23
25
27
31
33
35
37
41
43
45

CLIP STRIP DISPLAY UNIT

This invention relates to a clip strip display unit. That is to say, it relates to a display unit onto which a product may be clipped for display usually in connection with the sale of the product. It is particularly useful in displaying packaged products that are provided with a free edge panel that may be clipped onto this display unit to hold the package in position.

The nature of the setup or facility in which packaged products are to be displayed vary widely from one retail outlet to another. At some places, for example, the only thing available for securing a display unit are the shelves. In others, the only means present may be wire baskets or racks. Still in others, the vertical space that one can employ may permit a relatively long display holder. On the other hand, at some installations this vertical space may be severely limited.

It is an object of the present invention to provide a versatile package display unit that is suitable for use in most types of retail setups that one is likely to encounter.

Other and more detailed objects of this invention will be apparent from the following description, claims and drawings.

An embodiment of this invention is illustrated in the attached drawings wherein:

FIG. 1 a perspective view of a display unit of the present invention showing it secured to a shelf and containing three interlocking vertical expander units;

Figure 1:
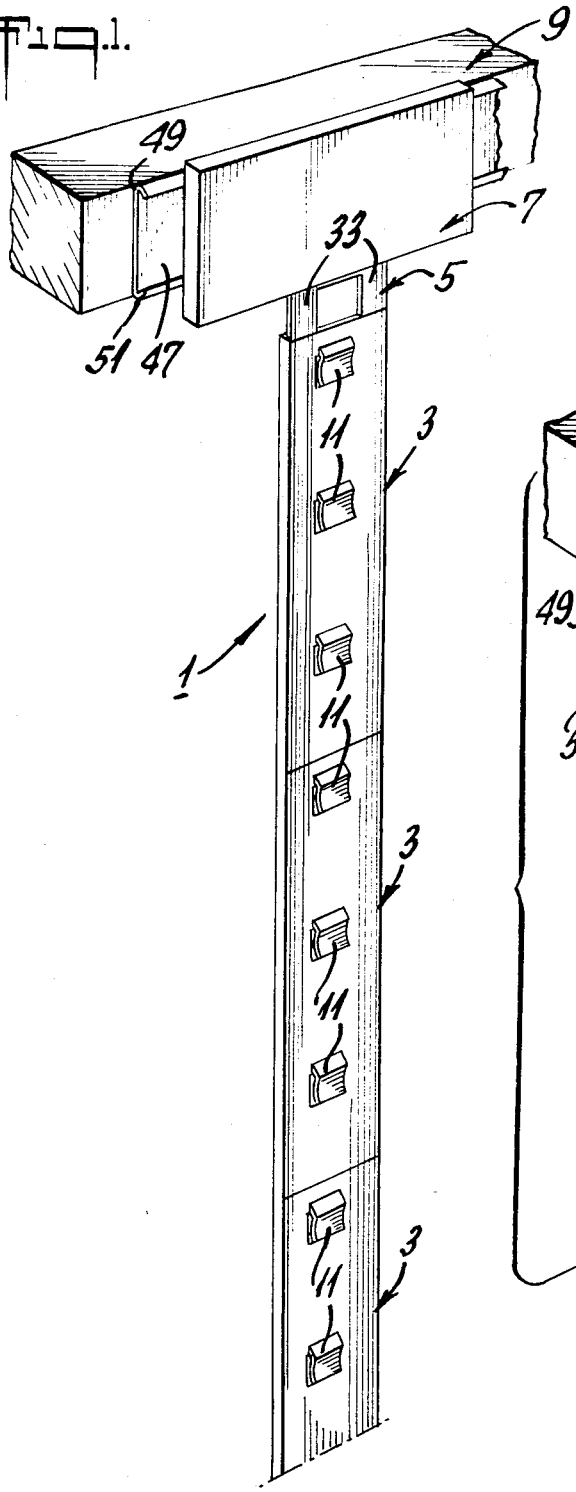

Referring to the drawings wherein the same numeral refers to the same structure in the various views, the display unit is shown generally at 1. The modification illustrated in FIG. 1 is provided with three vertical extender elements 3 that are detachably connected to each other. One or two of the lower extender elements 3 may be removed depending on the vertical space requirement or space limitation that is encountered at the retail outlet.

The modification of FIG. 1 is also provided with hanger element 5 and indicia element 7 each of which is detachably connected to the other. In addition, hanger element 5 is detachably connected to the uppermost extender element 3. The display unit 1 is shown in FIG. 1 as being secured to shelf 9 in a manner described in more detail below.

Figures 2, 3:
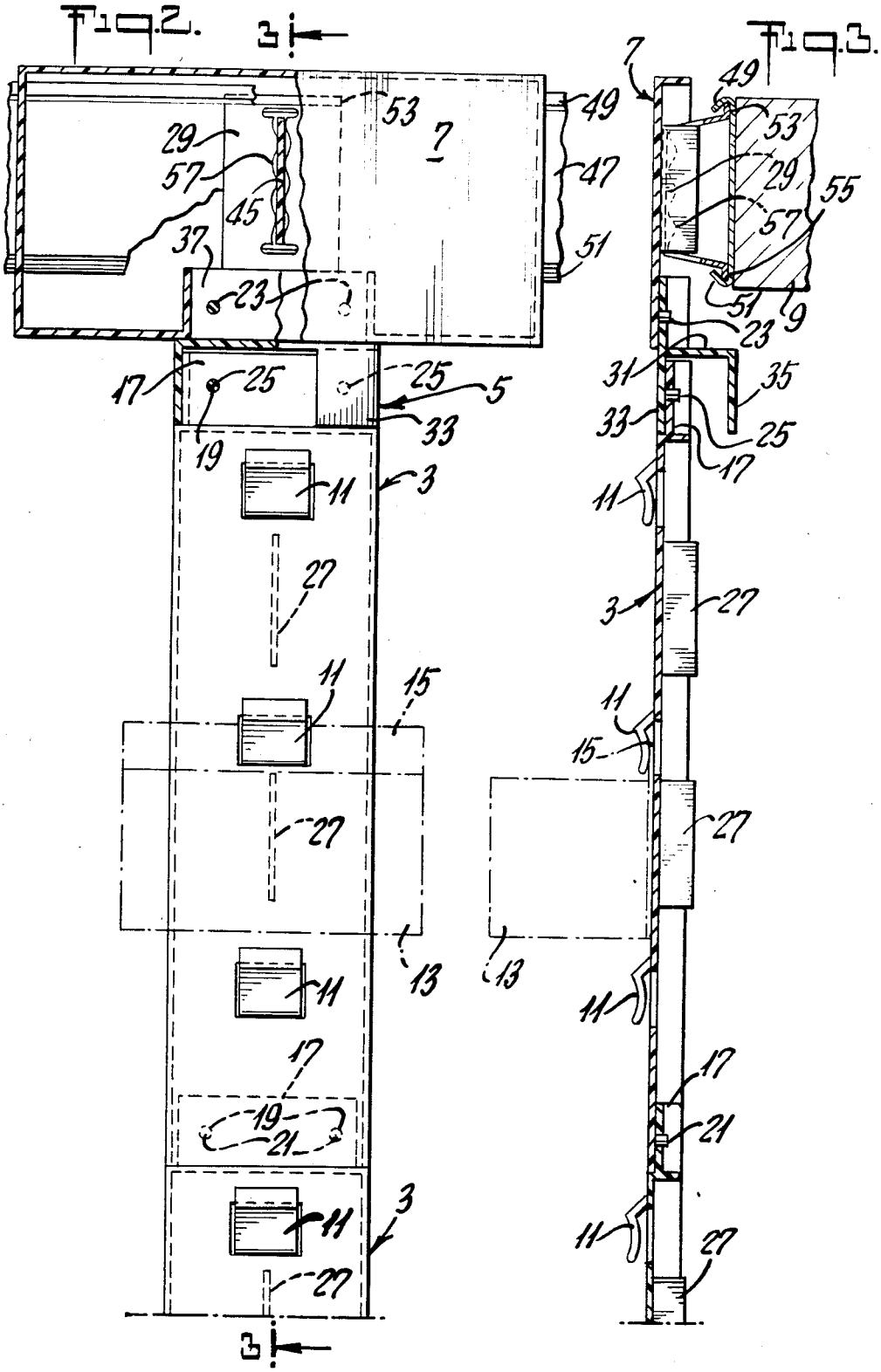
FIG. 2 is an enlarged front elevation of the display unit shown in FIG. 1 partly broken away at its top to show the manner in which the display unit may be secured to a shelf.
FIG. 3 is a longitudinal cross-sectional view taken along line 3—3 of FIG. 2.
Figures 5, 6, 7, 8, 9, 10:
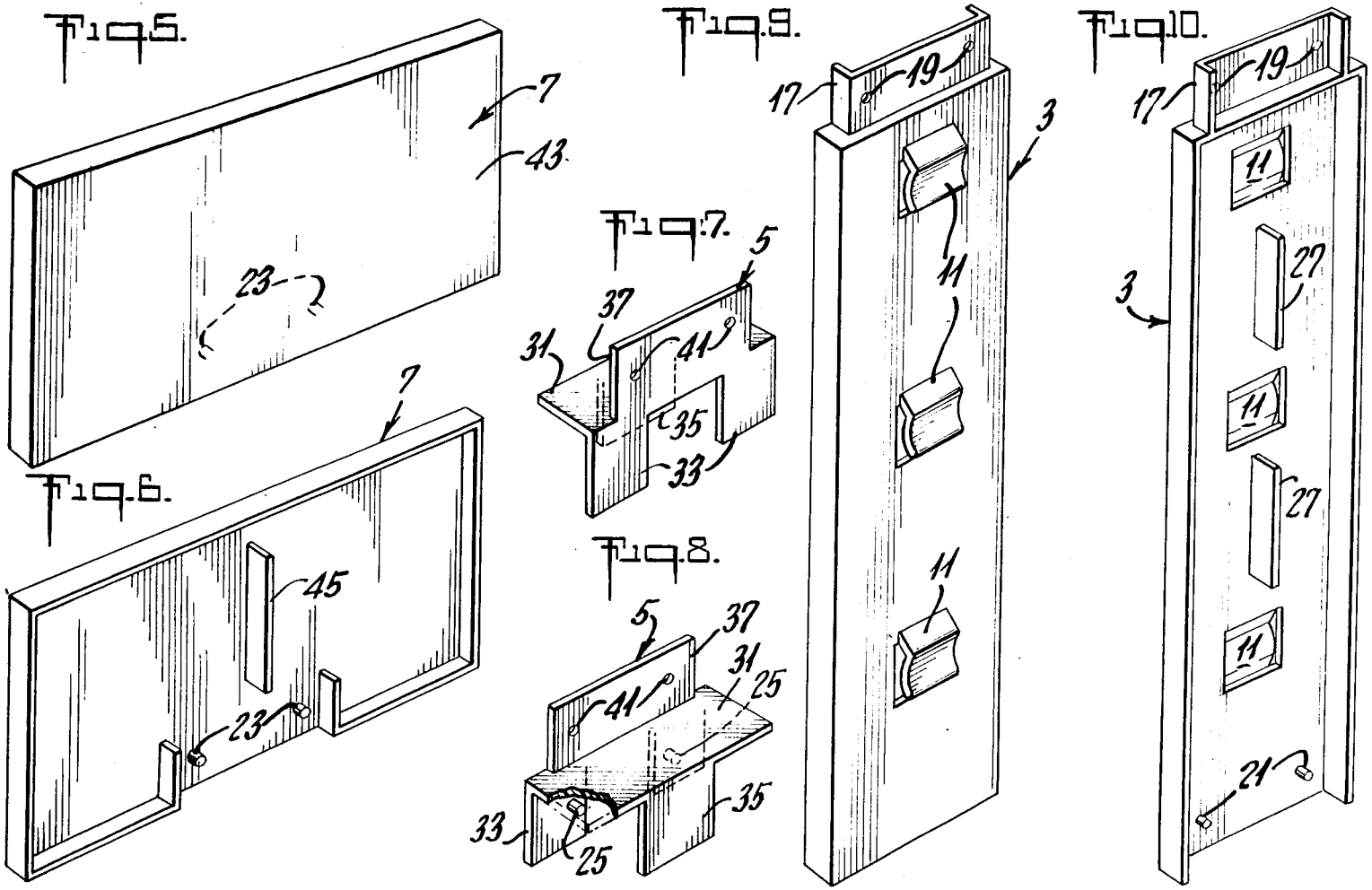
FIG. 5 is a perspective view of the indicia panel forming part of the display unit of this invention as seen from the front.
FIG. 6 is a rear view of the element shown in FIG. 5.
FIG. 7 is a perspective view of the hanger element forming part of the display unit of this invention as seen from the front.
FIG. 8 is a rear view of the element shown in FIG. 7 partly broken away to show the lugs on this element.
FIG. 9 is a perspective view of a vertical expander unit forming part of the display unit of the present invention as seen from the front.
FIG. 10 is a rear view of the element shown in FIG. 9.

The vertical extender elements 3 are best understood with reference to FIGS. 9 and 10. Extending outwardly from the front surface of extenders 3 there is provided a plurality of flexible clips 11 which are used to grasp the packaged product. Such a product package is shown at 13 in dotted line in FIGS. 2 and 3. As will be noted, there is provided a free edge panel 15 that extends upwardly from the upper surface of product package 13 which is grasped by clip 11 when the package is mounted in display unit.

Clips 11 may assume any of a variety of forms. In the preferred form of this invention, clips 11 are molded as part of and made integral with the front face of extender elements 3.

Extending upwardly from the upper surface of extender 3 and preferably made integral therewith, there is provided a U-shaped element 17. A pair of holes 19, that are variably adapted to accommodate lugs that are present on several of the elements forming part of display unit 1, are bored through element 17. Thus, lugs 21 protruding from the inner surface of an extender element 3 will fit into holes 19. In this fashion, the vertical dimension of the display holder 1 may be extended. Similarly, lugs 23 extending outwardly from the inner surface of indicia element 7 (see FIG. 6) will also fit into holes 19. In like manner, a pair of lugs 25 extending inwardly from the inner surface of the lower portion of hanger element 5 will also fit into holes 19. Extending outwardly from the back surface of extender elements 3, there is provided a plurality of rectangular projections 27. These are provided to give the user the option of attaching to element 27 a securing element similar to securing element 29 seen in FIG. 4.

A feature of the present invention is the provision of a hanger element 5 that may be snapped into holes 19 of extender 3. Hanger element 5 comprises a horizontal portion 31 from which extend downwardly a pair of front legs 33 and a rear leg 35. The inner side of each of the legs 33 is provided with an inwardly extending lug 25 that fits into holes 19 of extender element 3. Extending upwardly from horizontal element 31 is panel 37 through which are bored a pair of holes 41. The latter are adapted to receive lugs 23 of indicia element 7 when it is desired to use both hanger element 5 and indicia element 7 in the same setup.

A further feature of the present invention is the provision of an indicia element 7. This element is provided with a front flat broad surface 43 to which may be applied some written message regarding the products that are displayed in the display unit. Extending outwardly from the back side of indicia element 7 there is provided a pair of lugs 23 near the middle lower portion of element 7. As indicated previously, lugs 23 may be inserted through holes 41 via the front face of panel 37 of hanger element 5. The latter may in turn be attached to an extender element 3 as described below. In an alternative use, indicia element 7 may be secured directly to an extender element 3 by inserting lug 23 through holes 19 via the front face of U-shaped element 17.

Extending outwardly from the rear surface of indicia element 7 is a rectangular projection 45. This is used to engage securing element 29 for mounting display unit onto a shelf.

Figure 4:
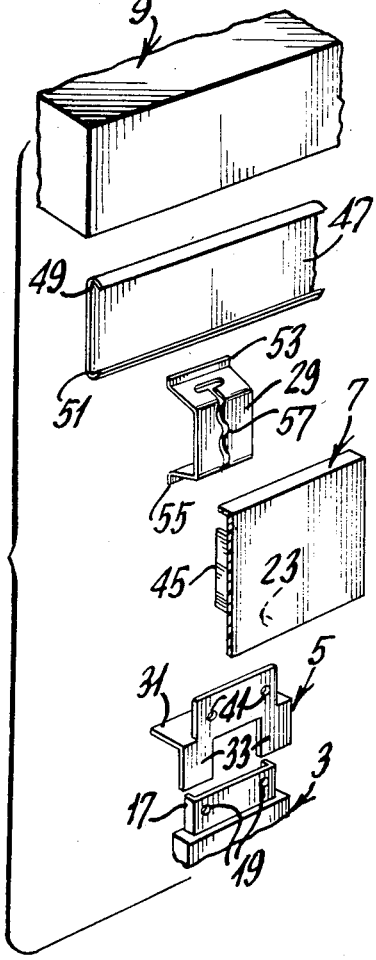
FIG. 4 is an assembly view of the display unit shown in FIG. 1 illustrating the manner in which the upper portion of this display unit is assembled and secured to a shelf.

The manner of mounting the present display unit on a shelf is best understood with reference to FIG. 4. A support mounting 47 is first secured to the front of shelf 9 in any suitable fashion well known to those skilled in this art. The upper and lower margins of mounting 47 are bent to form upper and lower channels 49 and 51, respectively. These channels are designed so that the upper and lower margins 53 and 55 of securing element 29 may be slid into these channels 49 and 51.

Securing element 29 is first snapped onto rectangular projection 45 through the serpentine slit 57 cut through the surface of securing element 29. Hanger element 5 is then attached to an assembly of vertical extender elements as described below. This combined assembly is then attached to indicia element 7 by means of holes 19 and lugs 23 in a manner described in more detail above.

In an alternative mounting of the display unit of the present invention on the shelf, the procedure outlined above is repeated excepting that in this instance the hanger element 5 is eliminated. In this case, the vertical extender element 3 or an assembly thereof is directly attached to the indicia element 7 as described.

In still a further manner of employing the present invention, the indicia element 7 is dispensed with entirely. In this case, the hanger element 5 is employed to mount the display unit on a wire basket or bar that can accommodate the hook configuration of the hanger element.

In another use of the present invention, both the hanger element and indicia elements 5 and 7, respectively, are dispensed with and the remaining portions of the display unit are mounted on the shelf in a support mounting 47. In this instance, a securing element 29 is attached directly to a rectangular projection 27 extending outwardly from the back surface of an extender element 3.

In still another use of the present invention, a pressure sensitive adhesive tape element (not shown) may be used to secure an assembly of extender elements 3 to a surface. A convenient way to accomplish this would be to lay the pressure sensitive adhesive element in the cradle formed by the inner surface of U-shaped element 17.

The several parts of the present display unit 1 may be fabricated from any of a variety of one or more materials. In a preferred form of this invention, the parts are made from the same material which is a moldable plastic which gives some flexibility to the parts. A number of plastics of this type are well known to those skilled in this art. However, a preferred material is medium impact styrene.

What is claimed is:

1. A clip strip display unit adapted to be mounted for displaying items in a multiplicity of fashions and to accommodate a variety of vertical spaces comprising:

(a) at least one vertical extender element; said vertical extender element being adapted to be removably secured to similar extender elements so as to be capable of varying the vertical dimension of the display unit; said vertical extender elements being provided with clip means for retaining items on the display unit;

(b) a hanger element removably secured to said extender element; said hanger element being adapted to be hung from a support to support said display unit; and (c) an indicia element removably secured to said hanger element; said indicia element having a surface on which a written message may be applied; said indicia element also being provided with means for securing said clip display unit to a support.

2. A clip strip display unit according to claim 1 wherein said extender elements are provided with front and back surfaces; said clip means extending outwardly from said front surface; said back surface being provided with outwardly extending projections which are adapted to receive a securing element that may be employed to secure said display unit to a support.

3. A clip strip display unit according to claim 2 wherein said extender elements are made removably securable to each by means of lug means in one element that cooperates with at least one hole in the other element.

4. A clip strip display unit according to claim 3 wherein said hanger element and said indicia element are made removably securable to each other by means of lug means in one of these elements that cooperates with at least one hole in the other element.

5. A clip strip display unit according to claim 4 wherein said hanger element is made removably securable to said extender element by means of lug means in one that cooperates with at least one hole in the other element.

6. A clip strip display unit according to claim 5 wherein said indicia element is made removably securable to said extender element by means of lug means in one that cooperates with at least one hole in the other.

* * * * *